United States Patent [19]

Newbanks

[11] 4,435,931

[45] Mar. 13, 1984

[54] GUY WIRE PROTECTOR DEVICE

[76] Inventor: James A. Newbanks, 205 W. Allen St., Apt. 318, Springfield, Ill. 62704

[21] Appl. No.: 229,465

[22] Filed: Jan. 29, 1981

[51] Int. Cl.[3] ..... E04H 12/20

[52] U.S. Cl. ..... 52/147; 52/230

[58] Field of Search ..... 52/147, 223 L, 230, 52/733; 174/79, 136; 73/862.39, 862.42; 403/310, 311, 312, 373, 374

[56] References Cited

U.S. PATENT DOCUMENTS

| | | | |
|---|---|---|---|
| 1,765,823 | 4/1928 | Burke | 52/147 |
| 1,832,138 | 11/1931 | Pounder | 174/79 |
| 1,933,818 | 12/1930 | Miller | 52/147 |
| 2,001,893 | 5/1935 | Seelye | 52/147 |
| 3,306,970 | 2/1967 | Kowalski | 174/79 |
| 3,368,319 | 2/1968 | Werner et al. | 52/148 |

FOREIGN PATENT DOCUMENTS

| | | | |
|---|---|---|---|
| 31241 | 12/1907 | Austria | 403/312 |
| 864282 | 7/1949 | Fed. Rep. of Germany | 52/148 |
| 930546 | 7/1955 | Fed. Rep. of Germany | 52/733 |

*Primary Examiner*—Price C. Faw, Jr.
*Assistant Examiner*—Mark J. Sufia
*Attorney, Agent, or Firm*—Haverstock, Garrett & Roberts

[57] ABSTRACT

A guy wire protector device is provided including a pair of semi-conical shaped body members each having a side surface of mating contour, a channel formed in at least one of the side surfaces and extending the length thereof for accommodating a length of guy wire positioned therein, the channel having a contour to grippingly engage the guy wire and prevent relative movement therebetween, and means to attach the body members and to hold them together with the guy wire extending along the channel.

18 Claims, 14 Drawing Figures

GUY WIRE PROTECTOR DEVICE

This invention relates generally to protective devices for wires and more particularly to protective devices for attaching to guy wires such as those used for supporting radio and television antennas and other structures to prevent ice that forms on the wires from damaging or releasing the anchor connections of the guy wires by sliding down the wires and striking the connections.

Guy wires supporting radio or television antennas or other structures are often connected to anchors by connectors of the chinese finger grip type which are tubular gripping members constructed so that when a guy wire is inserted into the grip and tension applied to the wire, the grip tightens to securely hold the guy wire. When the chinese finger type grip is compressed, the wire is released and may be withdrawn. During weather conditions such as occur during ice storms, heavy ice may form along the length of the guy wire and when the ice reaches sufficient weight or begins to melt or soften, it can start to move down the guy wire and may reach sufficient speed and with sufficient force to damage or release the chinese finger grip when the ice strikes the grip. If this happens, it can cause the tower or other supported structure to collapse or otherwise loosen or damage the connection beween the guy wire and the anchor. Other type guy wire connections can be damaged or loosened in the same way.

Prior art devices include guy wire protectors which are mounted directly to, or are slidable to a position where they rest on, the connector between the guy wire and the anchor. These prior art protectors are not suitable for protecting the guy wire anchor connections from sliding ice because blows from the sliding ice striking the top of these protectors are transmitted either directly or indirectly to the guy wire anchor connections. Examples of known prior art devices are disclosed in U.S. Pat. Nos. 1,902,414; 1,933,818; 2,001,893 and 3,926,141.

It is therefore a principal object of the present invention to teach the construction of an improved device to protect guy wire anchor connections from ice sliding down the guy wires.

Another object is to provide relatively simple, inexpensive and easy to install means to minimize the possibility of damage to the support member such as a guy wire due to ice formation thereon.

Another object is to reduce the chance of damage occurring to the structures supported by guy wires.

Another object is to teach the constructon of a guy wire protector device having the general shape of a frustum.

Another object is to teach the construction of a guy wire protector formed of two similar semi-conical shaped body members connectible together in a clamped relationship on the guy wire with the smaller end of the body members pointing upwardly.

Another object is to teach the construction of a guy wire protector having improved gripping means preventing the protector from sliding or moving along the guy wire when the protector is subjected to blows from ice sliding down the guy wire.

Another object is to teach the construction of a guy wire protector having improved guy wire gripping means including projections, longitudinal grooves, lateral grooves, helical grooves, or a roughened surface.

These and other objects and advantages of the present device will become apparent after considering the following detailed specification in conjunction with the accompanying drawings wherein.

Figure 4:
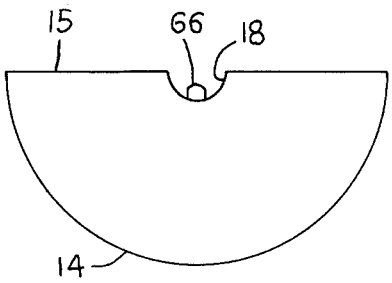
FIG. 4 is a view from the base end of the member of FIG. 3.

Referring to the drawings more particularly by reference numbers, 10 in FIG. 1 identifies a guy wire protector device having the general shape of a frustum with its smaller end directed upwardly to break apart and shed ice sliding down a guy wire 20 so that the ice falls harmlessly to the ground and does not damage the guy wire or its lower connector means as will be described. The device 10 has two semi-frusto-conical shaped body members 12 and 14 having guy wire receiving channels 16 and 18 respectively extending from the apex of the conical shape to the base along flat sides 13 and 15 of the members. The channels 16 and 18 may include gripping means, to be discussed later, which grip the guy wire 20 when the body members 12 and 14 are clamped together to prevent the device 10 from slipping or moving along the guy wire even when subjected to force.

Figure 1:
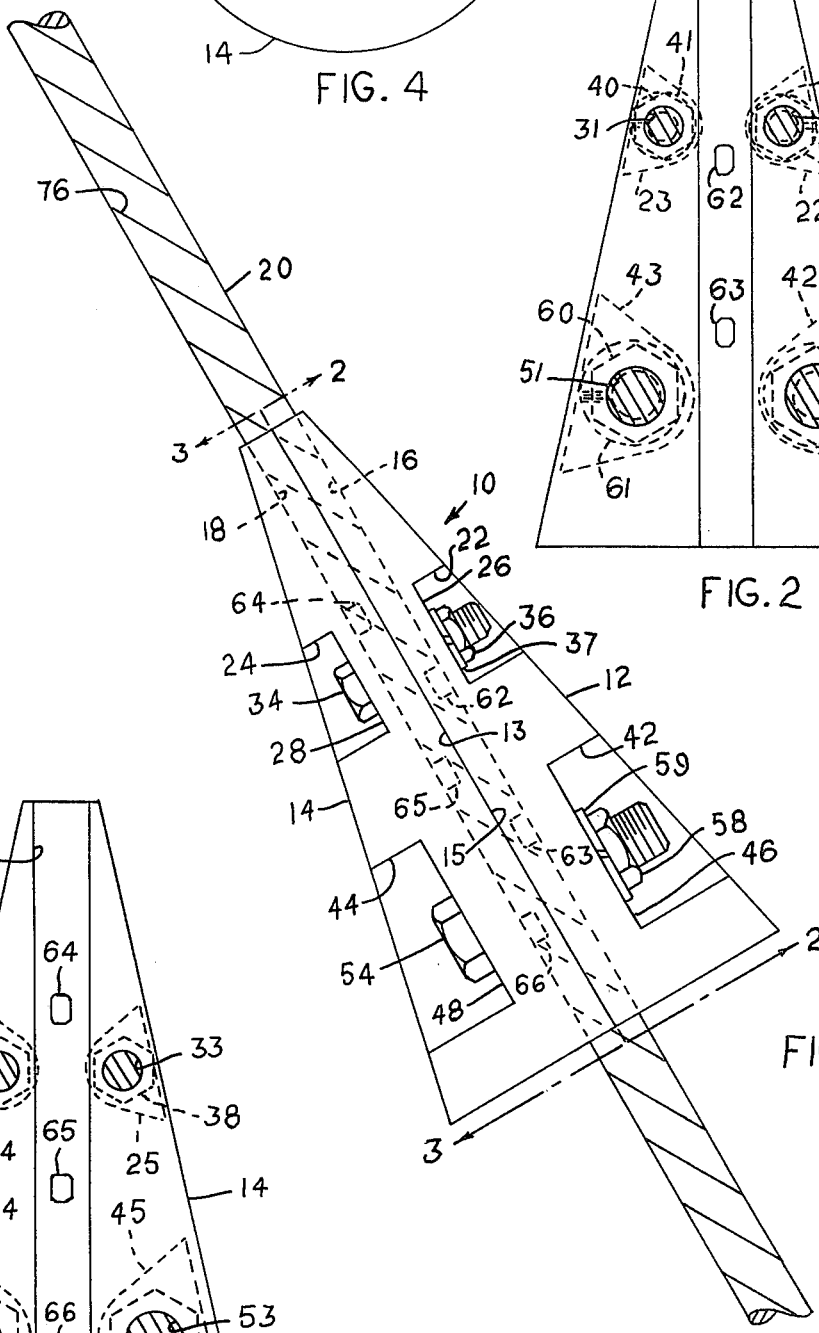
FIG. 1 is a side elevational view of a guy wire protector device shown clamped on a guy wire.
Figure 2:
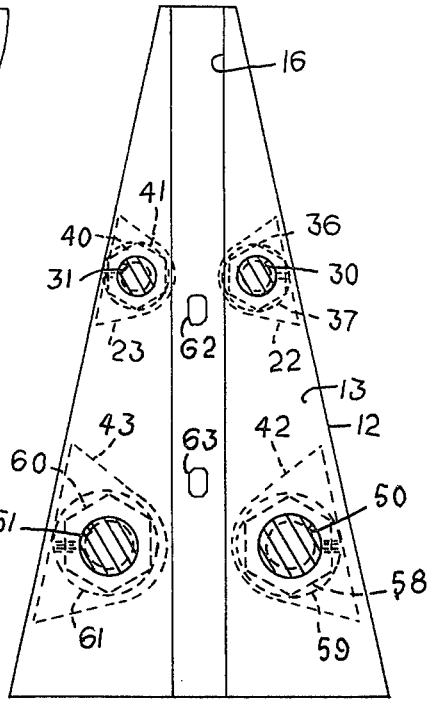
FIG. 2 is a view taken along lines 2—2 of FIG. 1.
Figure 3:
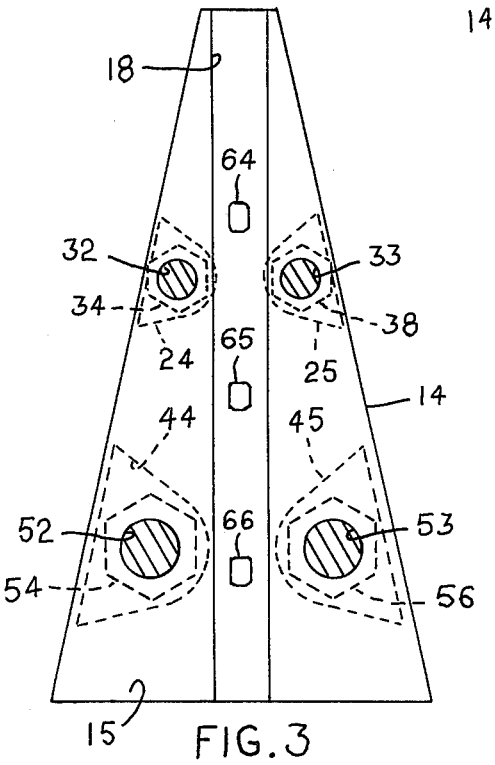
FIG. 3 is a view taken along lines 3—3 of FIG. 1.

Toward its smaller end, the body member 12 has cut out portions 22 and 23 (FIGS. 1 and 2), and the smaller end of body member 14 has similar cut out portions 24 and 25 (FIGS. 1 and 3). The cut out portions 22 and 25 have flat faces 26 and 28 respectively arranged to be parallel to one another along the longitudinal axis of the body 10. The cut out portions 23 and 24 have similar faces (not shown).

Extending through the members 12 and 14 at locations in the cut out portions 22, 23, 24, and 25 are holes 30, 31, 32, and 33 respectively which are arranged such that when the device is assembled as shown in FIG. 1, the holes 30 and 31 through body member 12 register respectively with the holes 32 and 33 through body member 14. A threaded member such as a bolt 34 passes through holes 30 and 32 and is secured in place by a nut 36 and lock washer 37 with the head of the bolt 34 bearing on the surface 28 and the lock washer 37 bearing on the surface 26 or vice versus. Another bolt 38 passes through holes 31 and 33 and is secured by nut 40 and lock washer 41. The depth of the groove on channels 16 and 18 should be such that it is necessary to draw the nuts and bolts up fairly tightly to produce the desired clamping action of the members 12 or 14 on the guy wire 20 without damaging the guy wire. Some small space may remain between the members even after they are clamped.

Other cut outs 42 and 43 are located near the larger end of the body member 12, and similar cut outs 44 and 45 are provided near the larger end of the body member 14. The cut outs 42 and 44 have flat parallel faces 46 and 48 respectively, and the cut outs 43 and 45 have similar parallel flat faces (not shown). In like manner the cut outs 42–45 communicate with holes 50–53 respectively in the members 12 and 14 for receiving thread attachment means such as bolts 54 and 56. Nuts 58 and 60 and associated lock washers are placed on the bolts 54 and 56 and tightened. When the nuts are tightened on the bolts, the clamped surfaces 16 and 18 are drawn against opposite sides of the guy wire 20 to produce a clamping action therewith.

The surfaces of the channels 16 and 18 may be roughened or contoured to increase the gripping and holding force of the subject device 10 when it is clamped in position thereon. Several forms for the clamped surface are described herein. One embodiment is shown in FIGS. 1–3 and includes providing spaced projections 62 and 63 in the wire receiving channel 16 of the member 12 and other spaced projections such as projections 64, 65 and 66 in the channel 18. As shown by hidden lines in FIG. 1, the spacing of projections 62 and 63 is such that when the members 12 and 14 are clamped together the projection 62 is centered between the projections 64 and 65 and the projection 63 is centered between the projections 65 and 66. Also, the longitudinal axis of the projections 62–66 preferably should be oriented in the channels 16 and 18 to be parallel to the longitudinal axis of the channels and/or the guy line 20. The projections 62–66 should project radially inwardly a sufficient distance to bite into the guy wire 20 (see FIGS. 1 and 4) thereby preventing sliding and rotation of the protector 10 when installed.

Figure 5:
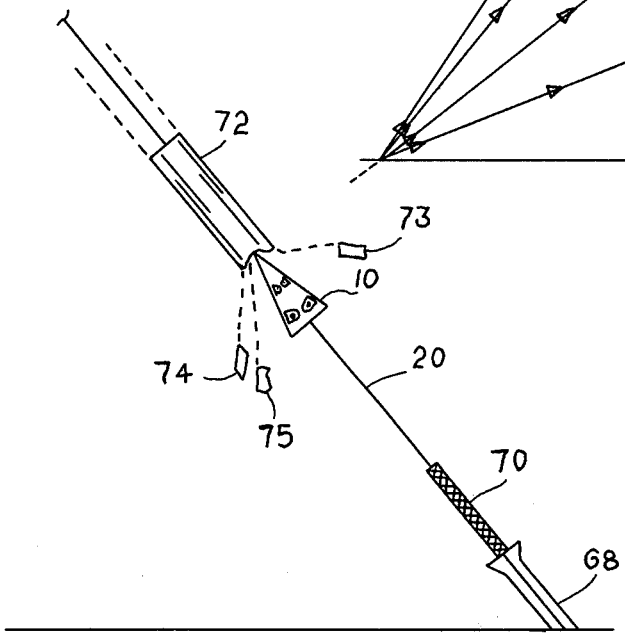
FIG. 5 is an illustration of the subject protector device mounted on a guy wire and shown being impacted by ice sliding down the guy wire.

FIG. 5 shows the protector device 10 mounted on a guy wire 20 which has its lower end attached to a fixed anchor 68 by means of a connector 70 such as a woven chinese finger connector. Such connectors are characterized by having their grip on the guy wire tighten as the tension on the guy wire increases. The grip in this kind of connector is reduced or released when the connector is placed in compression. In certain weather conditions such as during ice storms, ice will form on the guy wires 20 and in some conditions the ice may become thick and heavy until eventually a cylinder of ice 72 is formed. When the ice cylinder 72 reaches sufficient weight and/or the ice thaws or softens, the ice cylinder 72 or portions thereof will slide down the guy wire, sometimes from great heights and with great force, and will crash into the upper end of the connector 70. Such blows, if not prevented can compress the connector 70 which can then release its grip on the guy wire 20 causing the guy wire to loosen or in extreme circumstances can cause the supported structures to collapse or to buckle. The ice cylinder 72 may also cause physical damage to the connector 70 and to the anchor 68. The ice cylinder may also cause damage to other types of connectors used to anchor the guy wire 20. This is not possible when the guy wires 20 are equipped with protectors such as the protectors 10 which are installed on the guy wire 20 at spaced locations above the connector 70. Due to their conical shape, the protectors 10 split or fragmentize the ice cylinder 72 as they slide into the protectors, and cause the fragments to fly off harmlessly as illustrated in FIG. 5 by the pieces 73, 74 and 75.

The protectors 10 are particularly useful with standard guy wires, the outer strands of which form helices that extend along the length of the guy wire. The lay 76 of the outer strands of the guy wire form a right hand or a left hand helix, depending on the direction in which the particular guy wire was installed. The various forms of guy wire gripping means that can be employed by the device 10 as disclosed herein, include means preventing rotation of the device 10 along the lay of the helix 76 of the guy wire 20 in order that the device does not turn or rotate therewith when impacted by ice. The gripping means are also chosen to minimize or prevent the device from sliding longitudinally along the guy wire 20 or in a helical fashion.

Figure 6:
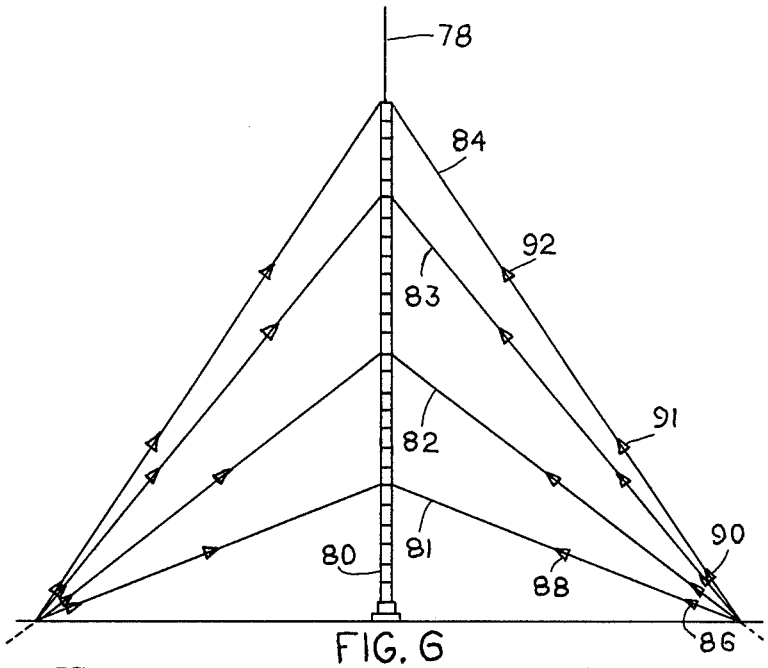
FIG. 6 is a simplified elevational view showing a tower structure supported by a number of guy wires equipped with protector devices constructed according to the present invention.

FIG. 6 is a simplified diagram showing an antenna 78 supported on a tower 80 which is held in place by a number of guy wires including guy wires 81, 82, 83 and 84. It is anticipated that guy wires extending outwardly from the tower 80 in at least three directions will be required. FIG. 6 shows a number of possible positions for the placement of protector devices such as the protector device 10. Protector devices 86 and 88 are shown placed on the lower guy wire 81 to each handle ice that may form along about half of the guy wire 81 including having the protector 86 placed closely adjacent to the connector means that fasten the guy wire 81 to its anchor. The upper guy wire 84 has three protectors 90, 91 and 92 located at spaced locations therealong. The greater number is chosen because of the greater length and the steeper incline of the upper guy wire 84. The number and spacing of the subject protectors not only depends on the length and incline, but should also take into consideration factors such as the weather condition and the history of icing conditions. It is usually also preferred to install the subject device at the time the guy wires are installed because of the ready access to the entire length of the guy wire. Once a guy wire is in place it may be difficult to install the devices other than relatively near the ends thereof.

Figure 8:
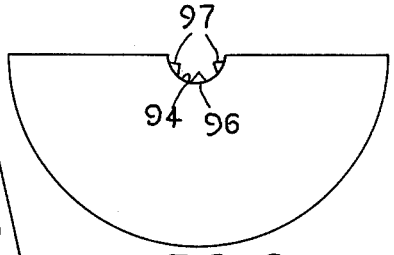
FIG. 8 is a bottom end view of the body member of FIG. 7.
Figure 7:
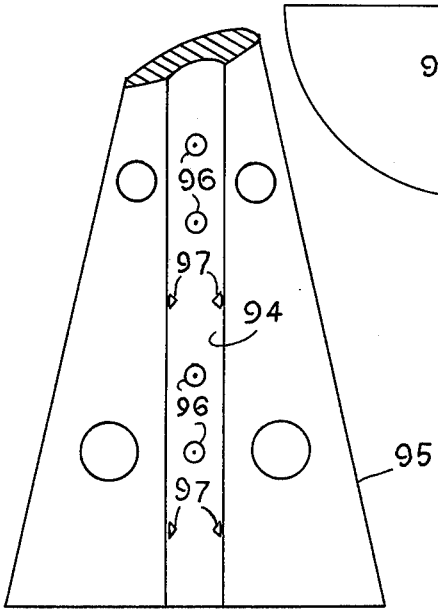
FIG. 7 is a fragmentary view of one body member of the device but showing another form of guy wire gripping means therefor.

Another embodiment of the means for gripping a guy wire is illustrated in FIGS. 7 and 8 wherein the wire receiving channel 94 in one or both of the body members such as body member 95 has a plurality of cone shaped projections 96 and 97 extending radially inwardly from the surface of the wire receiving channel 94 (FIG. 8) for engaging the guy wire. The conical projections 96 and 97 may have their points rounded to minimize cutting the strands of the guy wire, and the projections are shown arranged in rows parallel to the longitudinal axis of the shown channel 94. The pattern of the projections 96 and 97 illustrated in FIG. 7 is advantageous because it reduces the possibility for sliding as when imparted by ice moving along the guy wire and it provides lateral support for preventing the protector from turning on the guy wire along the lay 76 of the outer strands. The projections 96 and 97 should be made of a metal softer than the metal of the outer strands of the guy wire to prevent damage to the guy wire.

Figure 10:
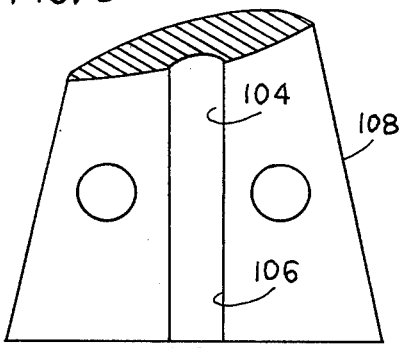
FIG. 10 is a fragmentary view showing another form of gripping means.
Figure 9:
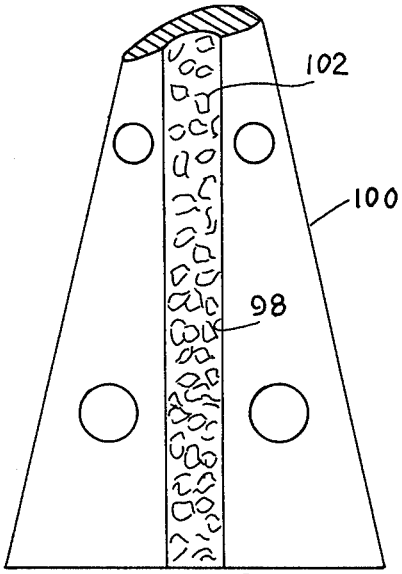
FIG. 9 is a fragmentary view showing another form of gripping means.

FIG. 9 shows another embodiment of gripping means wherein the wire receiving channels 98 along body member 100 has a roughened surface 102. FIG. 10 shows an embodiment of gripping means wherein the surfaces 104 along the channel 106 of body member 108 is smooth. In this case as in some of the other embodiments channels are sized to be somewhat smaller than the diameter of the guy wire on which they are attached so that some compressing of the guy wire into the channel 106 must take place when the body members 108 are clamped together.

Figure 11:
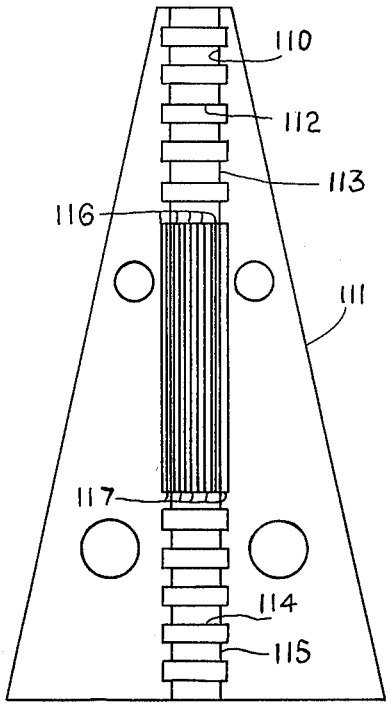
FIGS. 11-14 show still other embodiments of the gripping means for use on the subject device.

In the embodiment of FIG. 11, the wire receiving channel 110 of body member 111 is formed by a plurality of spaced annular grooves 112 and 114 in combination with a plurality of longitudinally extending grooves 116 and ridges 117 extending as shown. The ridge portions 113 and 115 between the annular grooves 112 and 114 are the parts that grip a guy wire and prevent the body member 111 from sliding or moving thereon. The ridges 117 prevent the body member 111 from turning on the outer strands of a guy wire.

Figure 12:
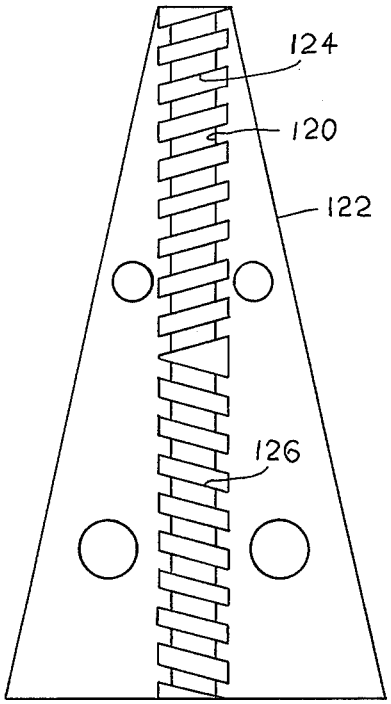

Another form of gripping means is shown in FIG. 12 wherein the wire receiving channel 120 along body member 122 is formed by a combination of helical groove portions 124 and 126 where the groove portions 124 and 126 are oppositely helical. When two similar body members 122 are clamped together they will form continuous oppositely extending helical grooves which engage a guy wire in a way to prevent movement on the guy wire.

Figure 13:
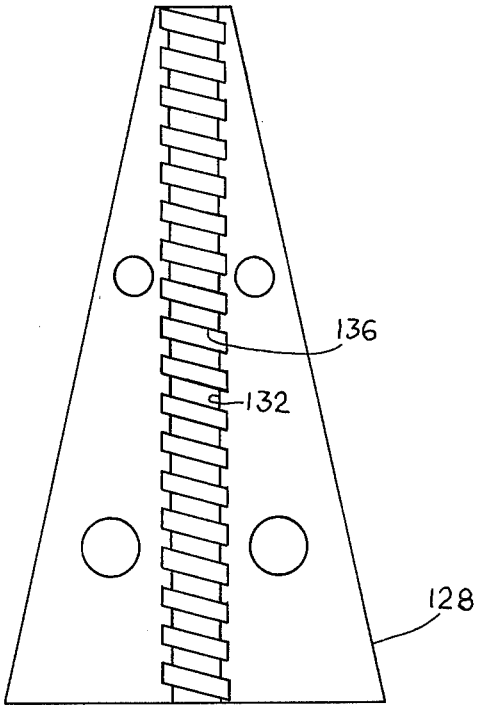
Figure 14:
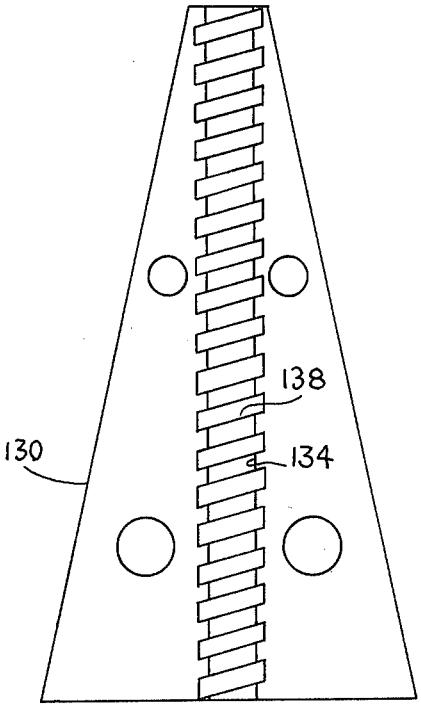

Other embodiments of gripping means are shown in FIGS. 13 and 14 wherein the protectors include body members such as member 128 which is clamped on a second similar body member 130 to form a protector device. The body members 128 and 130 have guy wire receiving channels 132 and 134 respectively. Channel 132 has formed therein helical groove portions 136, and channel 134 has formed therein helical groove portions 138. The wire receiving channels 132 and 134 are sized such that when the body members 128 and 130 are clamped together against opposite sides of a guy wire, the guy wire will be securely engaged and clamped. One of the sets of helical groove portions 136 or 138 will be crossed to the lay of the outer helical strands of the guy wire to help prevent the device when installed, from rotating along the lay of the outer strands of the guy wire. The angle of the groove portions 136 and 138 should also be selected to be small enough to give lateral support to the body members 128 and 130.

Combinations of one or more of the constructions shown in FIGS. 1–14 may be used in the construction including to provide gripping action with a guy wire. This includes also using partial or full length gripping means such as provided by the grooves 116 of FIG. 11, or by having spaced annular grooves such as the grooves 112 and 114 of FIG. 11 extending the full length of the members. It is usually preferred, however, to form the two body portions of the subject device to be identical as this reduces mold costs and inventory problems. The body members can be made of various materials including cast iron and cast steel, and galvanized bolts are preferred because of their resistance to deterioration and rusting in an exposed enviornment.

Thus there has been shown and described several embodiments of guy wire protector devices which fulfill all of the objects and advantages sought therefor. It will be apparent to those skilled in the art, however, that many changes, modifications, variations, and other uses and applications of the subject device are possible. All such changes, modifications, variations and other uses and applications of the device which do not depart from the spirit and scope of the invention are deemed to be covered by the invention which is limited only by the claims which follow.

What is claimed is:

1. A device mountable on guy wires and like supports for deflecting and splitting ice sheaths that form on the guy wires and subsequently slide therealong, each guy wire having opposed ends, one of which opposed ends is anchored to a fixed member and the opposite of which is connected to a structure to be supported thereby, said device comprising a pair of substantially alike interconnectable members, each member having spaced first and second ends of substantially semi-circular cross-section, the radius of said first end being smaller than the radius of the second end, an outer surface, and a substantially planar mating surface opposite the outer surface, said spaced first and second ends of each of said members defining a respective semi-frusto-conical shaped body envelope for each member, said outer surface of each member being disposed within said respective body envelope for such member, said mating surfaces having a longitudinal channel formed therein including a channel wall extending between said first and second ends, said outer surface of each of said interconnectable members tapering from said second end towards said first end to adjacent said channel wall at said first end, said members adapted to complementarily engage a guy wire when positioned therearound in a mating condition with said mating surfaces positioned adjacent to one another, said channels being registrable with one another when said members are so disposed in a mating condition to engage opposite sides of the guy wire about which said members are positioned, and means for connecting said members to one another about the guy wire at a fixed location therealong spaced from the opposed ends thereof, whereby said device facilitates the deflection and splitting of ice sheaths impacting said device at the first end thereof.

2. The device of claim 1 wherein the channel in at least one of said pair of members has a surface contoured for grippingly engaging the guy wire upon which said device is mountable for preventing relative movement between the device and the guy wire.

3. The device of claim 1 wherein the means to connect said members together about the guy wire include at least one pair of registered openings extending through said device when said members are disposed in a mating condition and joinder means extendible through said registered openings, said joinder means being completely insertable therewithin to be completely disposed within the confines of a body envelope of said device.

4. A guy wire protector device for protecting an inclined guy wire and a means connecting such guy wire to an anchor from objects sliding down the guy wire comprising: a sleeve-like body including a generally frustum shaped body portion having an outer wall and spaced first and second opposed ends, the first end having a smaller cross-sectional area than the second end, a channel extending longitudinally through the body portion between the opposed first and second ends, said channel adapted to accept in tight fitting engagement a length of guy wire, the outer wall of said body portion tapered to approximately adjoin the channel adjacent the first end of the body portion to facilitate the deflection of objects sliding down the guy wire; and means for clamping said body portion about a guy wire positioned in the channel at a fixed location along the guy wire remote from the means connecting the guy wire to an anchor, said clamping means including gripping means associated with said channel for preventing relative movement between said body portion and a guy wire positioned in said channel; said body portion including two substantially semi-conical shaped body members each having a substantially flat face on one side thereof, said body members being arranged to be clamped together by said clamping means with said substantially flat faces adjacent one another; said channel located along at least one of the adjacent faces to accommodate a length of the guy wire positioned therein; each of said pair of body members having a plurality of spaced holes therethrough, the respective holes in said members being registrable; said clamping means including threaded members extendible through said respective registered holes for fastening the body members together.

5. The guy wire protector device of claim 4 wherein said gripping means include means formed in said channel for grippingly engaging the guy wire.

6. The guy wire protector device of claim 4 wherein said gripping means include elongated projections formed on the surface of the channel.

7. The guy wire protector device of claim 4 wherein said gripping means include spaced projections found on the channel.

8. The guy wire protector device of claim 4 wherein said gripping means includes a plurality of spaced transverse grooves found in the surface of said channel.

9. The guy wire protector device of claim 4 wherein said gripping means include spaced helical shaped grooves in the surface of said channel.

10. The guy wire protector device of claim 4 wherein the surface contour of the channel in at least one of the body members is relatively uneven.

11. The guy wire protector device of claim 4 wherein the surface contour of the guy wire receiving channel in at least one of the body members is smooth.

12. The guy wire protector device of claim 4 wherein the surface of the channel in at least one of the body members is relatively abrasive.

13. Apparatus to prevent ice forming on guy wires from damaging a means connecting the guy wire to an anchor, said apparatus comprising an elongated guy wire having a first end and a second end, means connecting the first end to an anchor, means attaching the second end to a structure to be guyed thereby, and ice deflecting means mounted on the guy wire at a fixed location spaced from the ends thereof and engaging only the guy wire for preventing ice forming on the guy wire from moving down the guy wire and exerting a damaging force upon the means connecting the guy wire to the anchor, said deflecting means including a tapered sleeve having a smaller first end, a larger opposite end, an outer surface extending between said smaller first end and larger opposite end, and means forming a channel extending longitudinally through said sleeve between the smaller first end and the larger opposite end thereof for the guy wire to extend through, said outer surface tapered to approximately adjoin the guy wire extending through said channel at a location adjacent said smaller first end, said sleeve including first and second portions, said first and second portions being substantially alike and each including a portion of said channel, and means connecting said first and second portions together in clamping engagement with the guy wire.

14. The apparatus of claim 13 wherein the sleeve is frusto-conical in shape.

15. The apparatus of claim 13 wherein the means connecting said first and second portions together in clamping engagement with the guy wire include means compressing said guy wire between said portions.

16. The apparatus of claim 13 wherein the larger opposite end is located closer than the smaller end to the first anchored guy wire end.

17. The apparatus of claim 13 including a plurality of substantially alike deflecting means mounted in spaced relationship on the guy wire between the first and second ends of the guy wire, all of said deflecting means on the guy wire having the same orientation thereon.

18. The apparatus of claim 13 wherein the channel includes means associated therewith for maintaining the relative position of the deflecting means on the guy wire.

* * * * *